US011304535B2

(12) United States Patent
Myers et al.

(10) Patent No.: US 11,304,535 B2
(45) Date of Patent: Apr. 19, 2022

(54) MACHINE AND METHOD FOR ASSEMBLING A BEDDING FOUNDATION

(71) Applicant: L&P Property Management Company, South Gate, CA (US)

(72) Inventors: Jefferson W. Myers, Joplin, MO (US); Travis L. Brummett, Carthage, MO (US); Joshua A. Carrier, Carl Junction, MO (US); Richard L. McCune, Carthage, MO (US); Franklin H. Rawlings, Diamond, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 294 days.

(21) Appl. No.: 15/994,718

(22) Filed: May 31, 2018

(65) Prior Publication Data

US 2019/0365114 A1 Dec. 5, 2019

(51) Int. Cl.
*A47C 23/05* (2006.01)
*A47C 19/02* (2006.01)
(Continued)

(52) U.S. Cl.
CPC ..... *A47C 23/05* (2013.01); *A47C 19/025* (2013.01); *A47C 23/02* (2013.01);
(Continued)

(58) Field of Classification Search
CPC ..... B21F 27/16; B21F 33/02; B21F 33/025; B27F 7/17; B27F 7/00; B27F 7/003; B27F 7/006; A47C 23/05
(Continued)

(56) References Cited

U.S. PATENT DOCUMENTS 3,538,573 A * 11/1970 Ciampa ..... B27F 7/15 29/91
3,717,924 A * 2/1973 Kennedy ..... B27F 7/17 29/432

(Continued)

OTHER PUBLICATIONS

TopOff™ Operator Manual, release 2, Jul. 2015, Global Systems Group, a division of Leggett & Platt Incorporated, Sunrise, FL, USA (50 pages).

(Continued)

*Primary Examiner* — Christopher M Koehler
(74) *Attorney, Agent, or Firm* — Michael Best & Friedrich LLP

(57) ABSTRACT

An apparatus for assembling a bedding foundation having spring modules and a frame includes a support configured to receive the frame, a bridge disposed over the support, and staplers movably coupled to the bridge and positioned over the support, each stapler configured to staple a spring module to the frame. The apparatus also includes cameras coupled to the bridge and positioned over the support. Each stapler is operatively associated with one of the cameras and each camera is positioned to provide a field of view toward the support. The apparatus also includes a driver configured to move the frame relative to the support and a controller in communication with the cameras and the driver, the controller configured to receive vision guidance signals from one of the cameras to direct movement of the driver and of the stapler operatively associated with the one of the cameras.

13 Claims, 11 Drawing Sheets

(51) Int. Cl.

| | |
|---|---|
| ***A47C 23/02*** | (2006.01) |
| ***A47C 23/043*** | (2006.01) |
| ***B21F 33/04*** | (2006.01) |
| ***B21F 27/16*** | (2006.01) |
| ***B27F 7/00*** | (2006.01) |
| ***B21F 33/02*** | (2006.01) |

(52) U.S. Cl.
CPC ..... *A47C 23/0438* (2013.01); *B21F 27/16* (2013.01); *B21F 33/025* (2013.01); *B21F 33/04* (2013.01); *B27F 7/003* (2013.01); *B27F 7/006* (2013.01)

(58) Field of Classification Search
USPC ..... 29/91
See application file for complete search history.

(56) References Cited

U.S. PATENT DOCUMENTS

| | | | | |
|---|---|---|---|---|
| 3,789,495 | A * | 2/1974 | Stumpf | B21F 33/04 29/429 |
| 4,845,824 | A * | 7/1989 | Ishikawa | B21F 33/025 29/243.57 |
| 5,904,789 | A * | 5/1999 | Durkos | B27F 7/006 156/378 |
| 6,220,494 | B1 * | 4/2001 | Raffoni | B27F 7/006 227/111 |
| 6,935,546 | B2 | 8/2005 | Durkos | |
| 7,222,402 | B1 | 5/2007 | Durkos | |
| 7,467,454 | B2 | 12/2008 | Durkos | |
| 7,490,401 | B2 | 2/2009 | Mossbeck et al. | |
| 2003/0154589 | A1 * | 8/2003 | Koch | B27F 7/17 29/525.02 |
| 2004/0089695 | A1 * | 5/2004 | Svensson | B27F 7/006 227/99 |

OTHER PUBLICATIONS

Description of TopOff™ stapling machine, with Statement of Relevance (7 pages).

* cited by examiner

MACHINE AND METHOD FOR ASSEMBLING A BEDDING FOUNDATION

BACKGROUND

The present disclosure relates to machines and methods for assembling bedding foundations, and more particularly to a machine and method for fastening spring modules to a wooden frame.

SUMMARY

In one aspect, the present disclosure provides an apparatus for assembling a bedding foundation having a grid formed from rows of spring modules and a frame to support the grid includes a horizontal support configured to receive the frame, the horizontal support having a length defining a lengthwise direction and a width, a bridge spaced over the support and spanning at least partially across the width, and a bank of staplers. Each stapler in the bank of staplers is movably coupled to the bridge and positioned over the horizontal support. Each stapler in the bank of staplers is configured to staple a spring module of the grid to the frame, and each stapler of the bank of staplers further configured to move in a linear vertical direction relative to the horizontal support independently of each of the other staplers in the bank of staplers and to pivot in the lengthwise direction independently of each of the other staplers in the bank of staplers. The staplers are movably coupled to the bridge to adjust a spacing therebetween in a direction across the width of the horizontal support. The apparatus also includes actuators coupled to the bridge, and each stapler of the bank of staplers is operated by one of the actuators to pivot in the lengthwise direction In another aspect, the present disclosure provides an apparatus for assembling a bedding foundation having spring modules and a frame includes a support configured to receive the frame, a bridge disposed over the support, and staplers movably coupled to the bridge and positioned over the support, each stapler configured to staple a spring module to the frame. The apparatus also includes cameras coupled to the bridge and positioned over the support. Each stapler is operatively associated with one of the cameras and each camera is positioned to provide a field of view toward the support. The apparatus also includes a driver configured to move the frame relative to the support and a controller in communication with the cameras and the driver, the controller configured to receive vision guidance signals from one of the cameras to direct movement of the driver and of the stapler operatively associated with the one of the cameras.

In another aspect, the present disclosure provides a method of using a vision guided control system having a camera system and a controller to assemble a bedding foundation comprising a grid formed from rows of spring modules and a frame to support the grid. The method includes placing the frame on a horizontal support having a length and a width, placing the grid of spring modules on the frame, adjusting a spacing of select staplers in the overhead bank of staplers in a direction across the width of the horizontal support in response to a visual guidance signal sent from the camera system to the controller, commanding a carriage to move the frame in a direction along the length of the horizontal support, stopping movement of the carriage to align a row of spring modules beneath the overhead bank of staplers in response to visual guidance signals sent from the camera system to the controller when the camera system identifies a predetermined number of spring modules in the row of spring modules as being aligned beneath the overhead bank of staplers, and using the camera system to direct stapling movement of select staplers in the bank of staplers to attach the grid to the frame.

In another aspect, the present disclosure provides an apparatus for assembling a bedding foundation having a grid formed from rows of spring modules and a frame to support the grid. The apparatus includes a support configured to receive the frame, the support having a length defining a lengthwise direction and a width, a bridge spaced over the support and spanning at least partially across the width, and a bank of staplers. Each stapler in the bank of staplers is movably coupled to the bridge and is configured to staple a spring module of the grid to the frame. Each stapler in the bank of staplers is further configured to move in a linear vertical direction relative to the support independently of each of the other staplers in the bank of staplers and to pivot relative to the support in the lengthwise direction. At least two of the staplers are movably coupled to the bridge to adjust a spacing between at least two of the staplers in the bank of staplers in a direction across the width of the support.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

Figure 1:
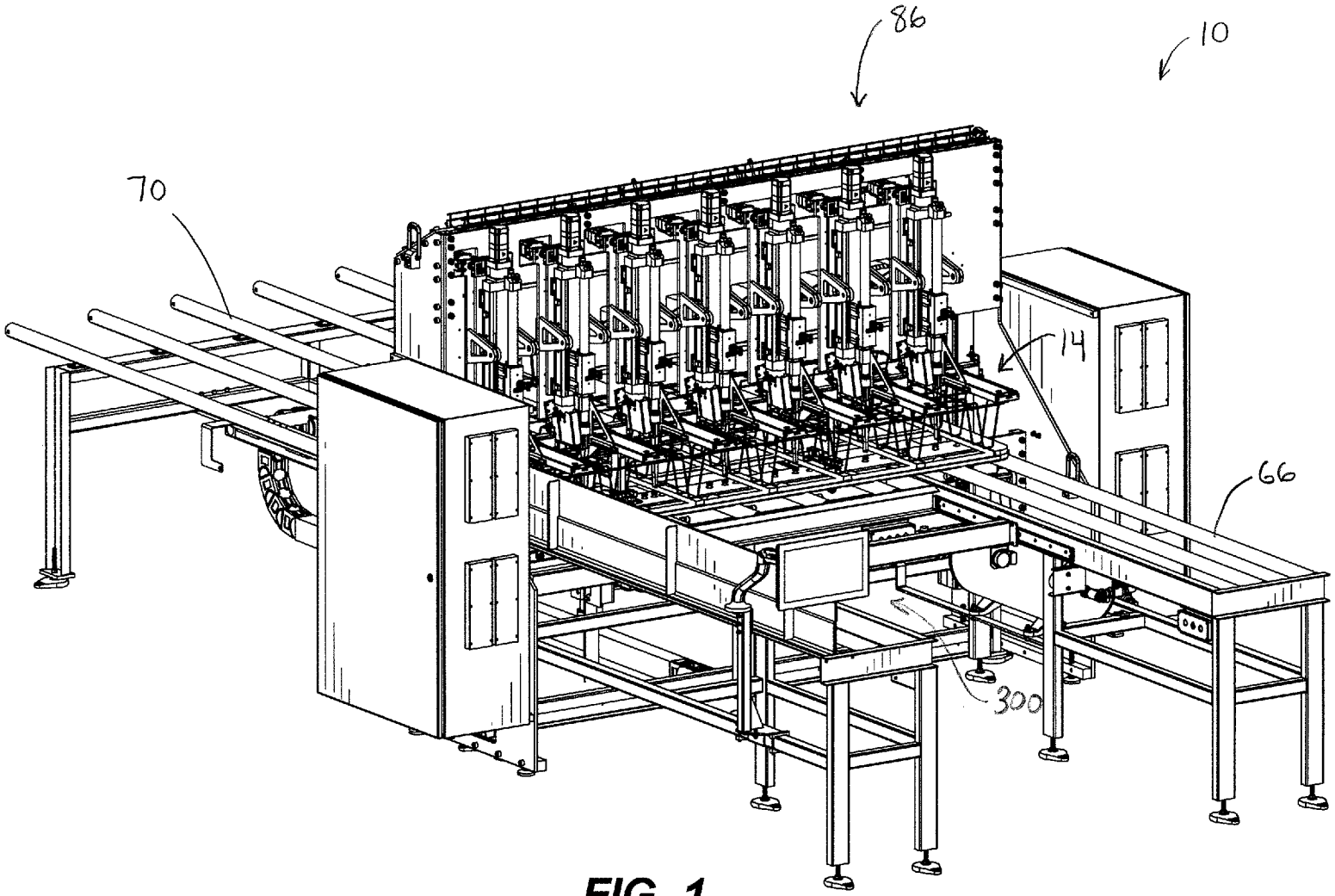
FIG. 1 is a perspective view of a machine for attaching components of a box-spring according to one embodiment of the disclosure.
Figure 2:
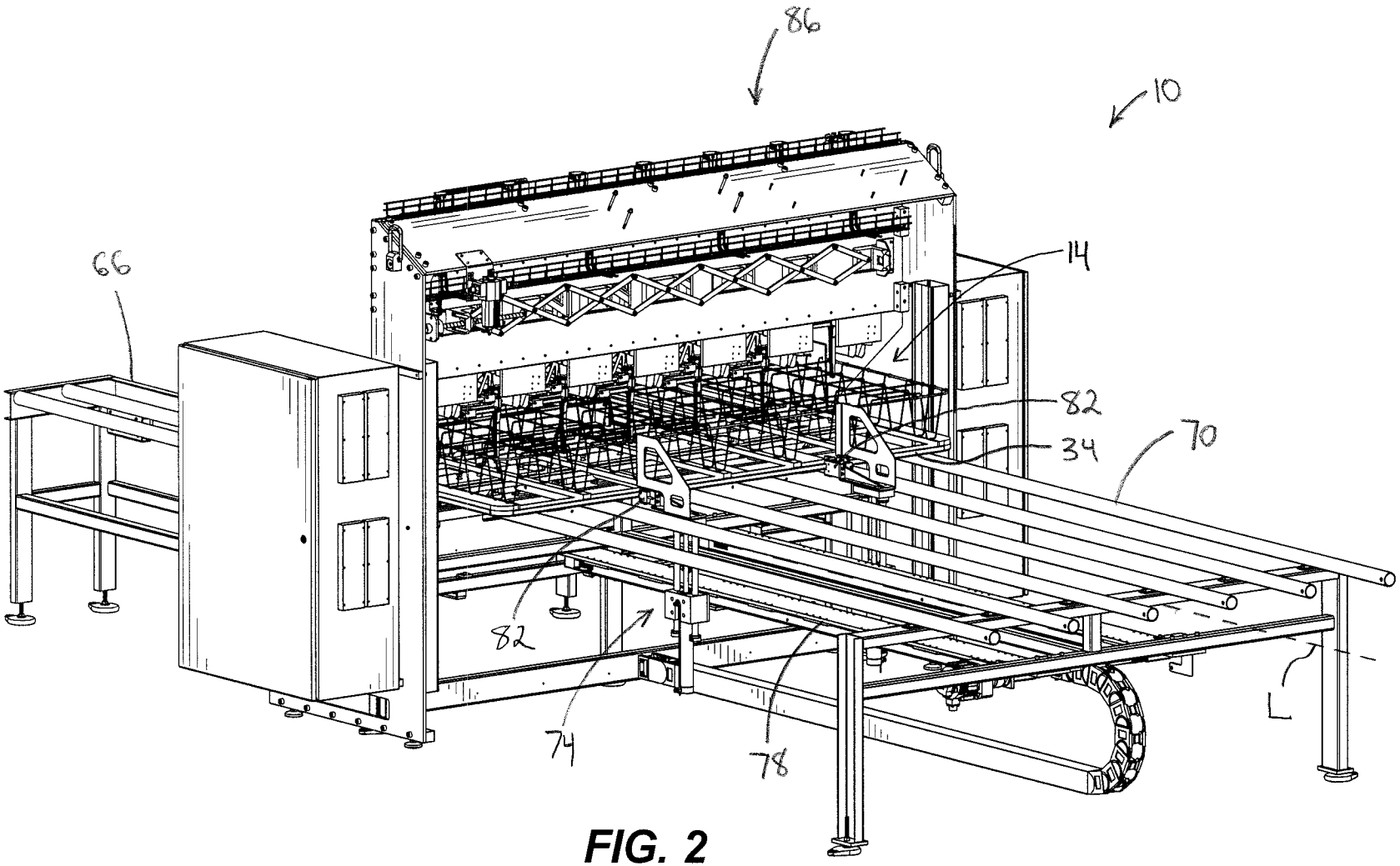
FIG. 2 is another perspective view of the machine of FIG. 1.
Figure 3:
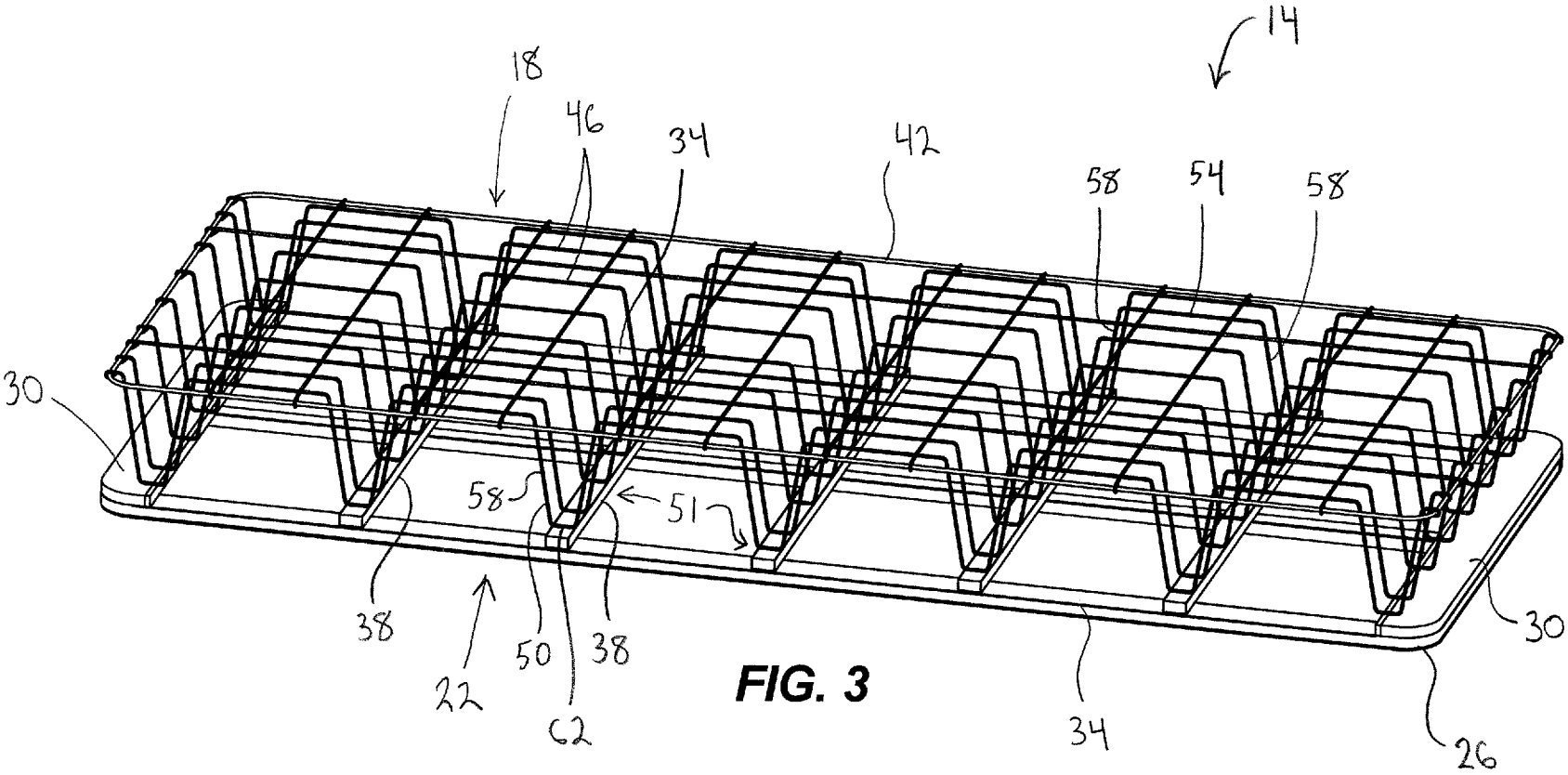
FIG. 3 is a perspective view of a box-spring assembled by the machine of FIG. 1.

FIGS. 1 and 2 illustrate a machine 10 for assembling bedding foundations or box-springs 14 of various types and sizes. One exemplary box-spring 14 that can be assembled by the machine 10 is illustrated in FIG. 3. The illustrated box-spring 14 includes an upper wire grid 18 and an underlying wood support frame 22. The support frame 22 of the box-spring 14 is rectangular and includes an outer frame 26 formed by two parallel longitudinal slats 30 coupled by two transverse cross slats 34 at each end. The support frame 22 can be sized according to a standard bedding size, such as king, queen, double, or twin. Interior longitudinal slates 38 coupled to the transverse cross slates 34 are evenly spaced between the outer longitudinal slats 30.

The wire grid 18 includes a border wire 42 and a plurality of interior transverse wires 46 that are evenly spaced along a length of the wire grid 18. Each interior wire 46 extends across a width of the grid 18 and is coupled at its ends to opposite lateral sides of the border wire 42. Each transverse wire 46 is continuous from one side of the wire grid 18 to the other and forms a series of regularly spaced valleys or troughs 50 each positioned between opposed peaks 54 that are generally horizontal and coplanar with the border wire 42. Each trough 50 forms an individual spring module 51 with two side portions 58 that each extend downwardly from one of the opposed horizontal peaks 54, and a bottom horizontal portion 62 that connects the two side portions 58. The bottom or foot portion 62 of each trough 50 is fastened (e.g., stapled) to one of the longitudinal slats 30, 38 of the underlying wood frame 22, as will be further explained. In some embodiments, the shape of each spring module 51 above the foot portion 62 may vary. For example, the spring modules 51 may be shaped as spirals or coils. In the illustrated embodiment, each transverse wire 46 forms a single row of seven spring modules 51 that extends across the width of the wire grid 18. In other embodiments, each transverse wire 46 may form a greater or lesser number of spring modules 51.

Referring to FIGS. 1 and 2, the machine 10 includes an upstream load table 66 and an adjacent downstream carriage table 70 on which the box-spring 14 is supported during assembly. The terms "upstream" and "downstream" are used herein with reference to the direction the box-spring 14 travels during assembly by the machine 10. The load table 66 and the carriage table 70 define a longitudinal axis L, and the box-spring 14 is generally movable along the longitudinal axis L while being supported by the load table 66 and/or the carriage table 70 during assembly. A driver or transport carriage 74 is slidably disposed along a rail 78 underneath the carriage table 70 (FIG. 2). The transport carriage 74 includes a pair of retractable gripper arms 82 that are engageable with the box-spring 14 (e.g., with one of the cross slats 34). The transport carriage 74 is movable along the rail 78, in a direction parallel to the longitudinal axis L, to move the box-spring 14 along the longitudinal axis L (i.e. in a length direction of the tables 66, 70). The transport carriage 74 and the gripper arms 82 may be moved or actuated by one or more motors or other actuators such as solenoids, pneumatic cylinders, hydraulic cylinders, and the like. In some embodiments, two or more carriages 74 with gripper arms 82 are configured to move the box spring 14 along the longitudinal axis L.

Figure 4:
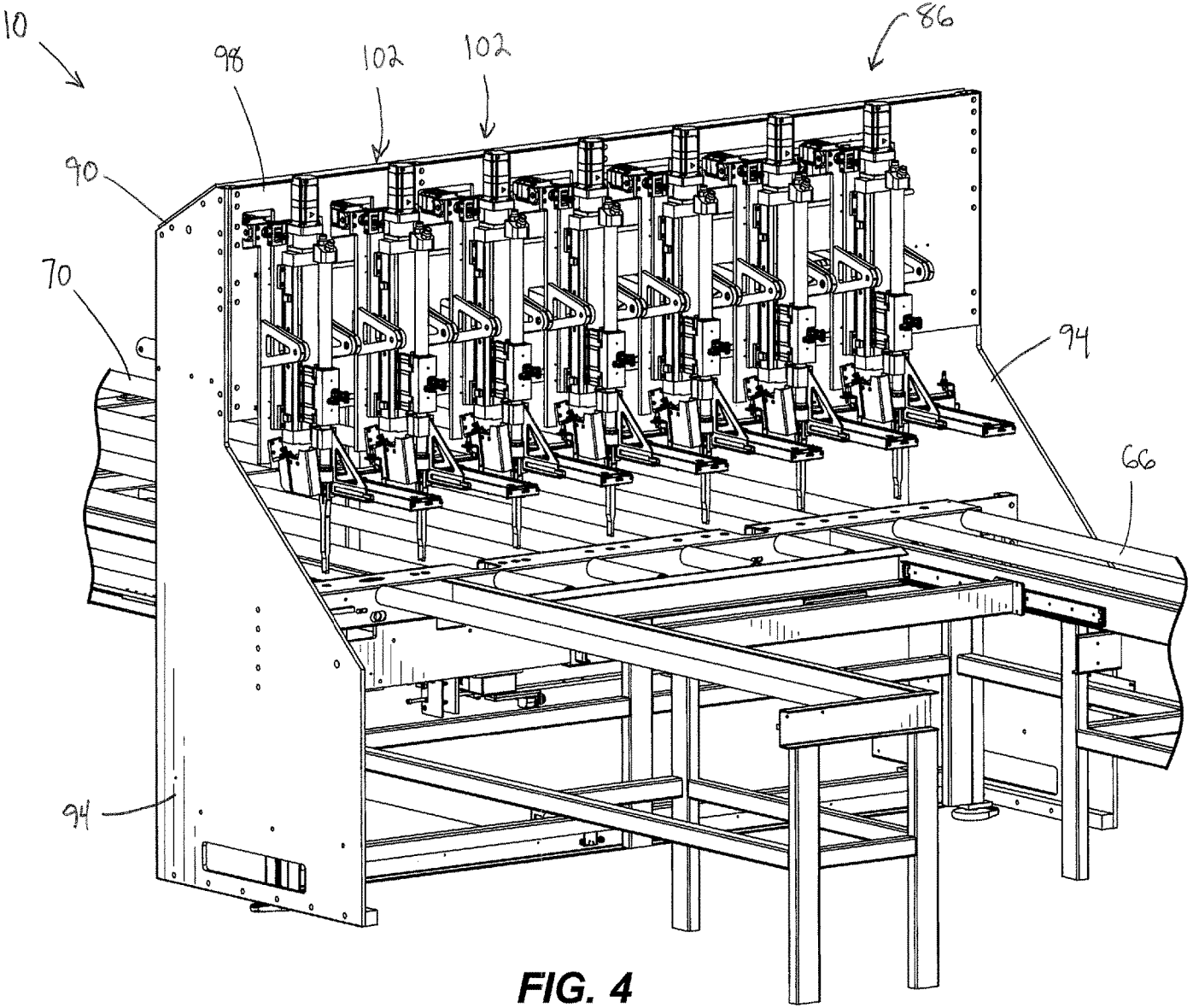
FIG. 4 is a perspective view illustrating a fastening assembly of the machine of FIG. 1.

With reference to FIG. 4, a fastening assembly 86 extends laterally between the load table 66 and the carriage table 70. In particular, the load table 66 is disposed on an upstream side of the fastening assembly 86, and the carriage table 70 is disposed on a downstream side of the fastening assembly 86. The fastening assembly 86 includes a structural support 90 with a pair of legs 94 disposed on opposite lateral sides of the tables 66, 70 and a bridge or center span 98 that extends between the legs 94 in a width direction of the tables 66, 70. As described in more detail below, a plurality of fastening units 102 is coupled to the center span 98 of the structural support 90 such that the fastening units 102 are suspended over the tables 66, 70.

Figure 7:
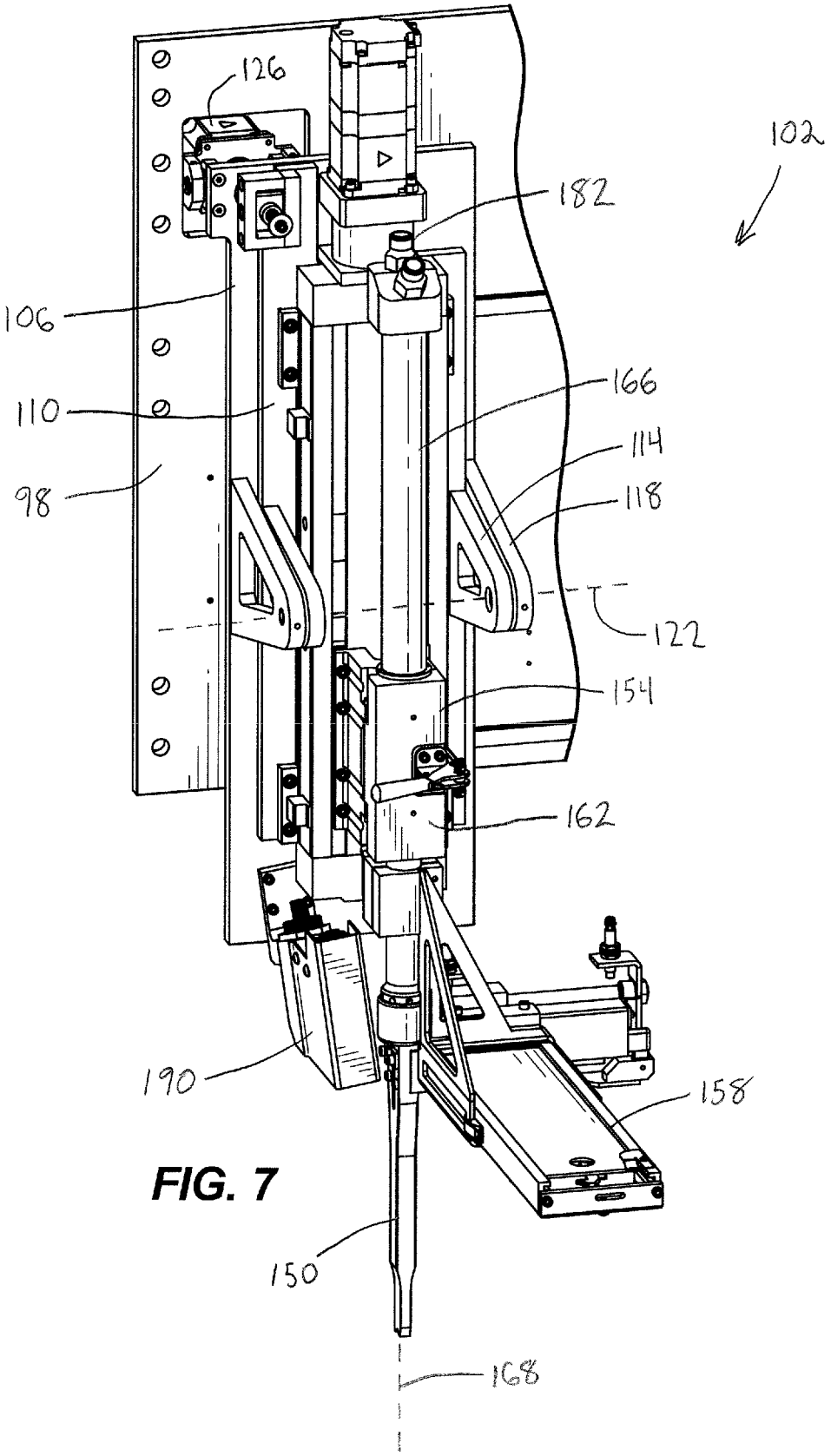
FIG. 7 is a perspective view of a fastening unit of the fastening assembly of FIG. 4.
Figure 8:
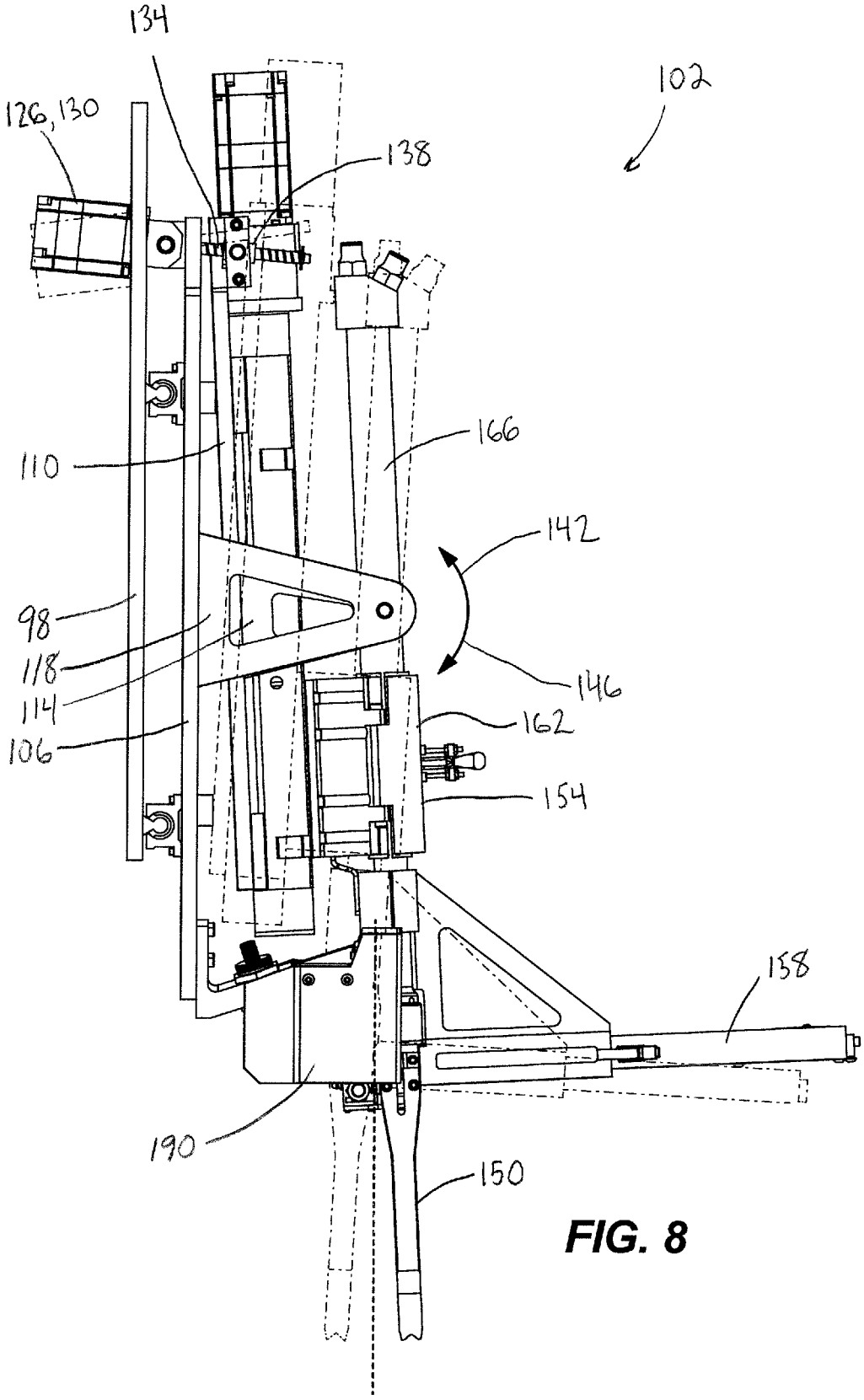
FIG. 8 is a side view of the fastening unit of FIG. 7 illustrating pivoting movement of a stapler of the fastening unit.

Each of the fastening units 102 includes a mounting plate 106 coupled to the center span 98 and a support plate 110 coupled to the mounting plate 106 (FIG. 7). Forwardly-projecting brackets 114 on the support plate 110 are nested between a pair of forwardly-projecting brackets 118 on the mounting plate 106. The respective brackets 114, 118 are pivotally coupled such that the support plate 110 is pivotable relative to the mounting plate 106 about a pivot axis 122. As shown in FIG. 8, pivot actuator 126 controls pivotal movement of the support plate 110 relative to the mounting plate 106. In the illustrated embodiment, the pivot actuator 126 includes a motor 130 and a threaded rod 134 rotationally driven by the motor 130 (FIG. 8). The threaded rod 134 extends through a threaded bushing 138 coupled to the support plate 110 at an upper end of the support plate 110. Accordingly, rotation of the threaded rod 134 in a first direction draws the upper end of the support plate 110 toward the pivot actuator 126, causing the support plate 110 to pivot upward in the direction of arrow 142. Likewise, rotation of the threaded rod 134 in a second, opposite direction moves the upper end of the support plate 110 away from the pivot actuator 126, causing the support plate 110 to pivot downward in the direction of arrow 146. The pivot actuator 126 is itself pivotally supported on the center span 98, allowing it to move (i.e., rotate) to maintain the alignment of the threaded rod 134 and bushing 138. In other embodiments, other types and/or arrangements of pivot actuator(s) (e.g., solenoids, air or hydraulic-operated pistons, etc.) may be used to control pivotal movement of the support plate 110 relative to the mounting plate 106.

Figure 9:
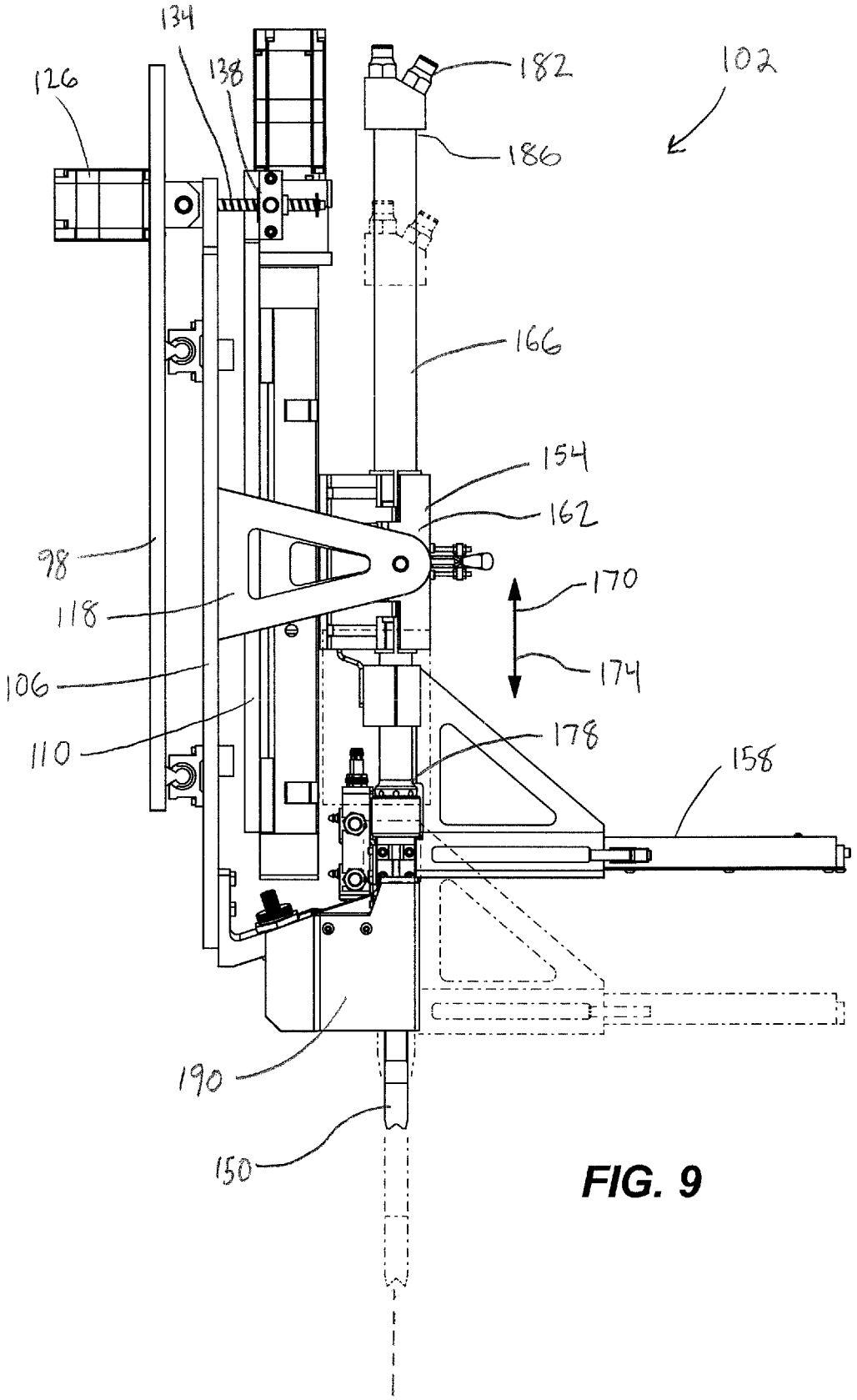
FIG. 9 is a side view of the fastening unit of FIG. 7 illustrating linear movement of a stapler of the fastening unit.

With reference to FIG. 7, each fastening unit 102 includes a fastening device or stapler gun or stapler 150 coupled to a linear actuator 154, which in turn is coupled to the support plate 110. In the illustrated embodiment, the stapler 150 is an air-powered stapler operable to discharge staples into the wood support frame 22 to fasten the wire grid 18 to the frame 22 (FIG. 3). In other embodiments, the fastening unit 102 may include other types of fastening devices. A magazine 158 is coupled to the stapler 150 to store and feed staples into the stapler 150. The linear actuator 154 includes a base 162 fixed to the support plate 110 and a rod 166 that is linearly displaceable relative to the base 162 along an axis 168 in the directions of arrows 170 and 174 (FIG. 9), between an upper or rest position and a lower or actuated position. As shown in FIG. 9, the stapler 150 and the magazine 158 are coupled to a first end 178 of the rod 166, and in the illustrated embodiment air fittings 182 are provided on a second end 186 of the rod 166. The air fittings 182 are coupled to air hoses (not shown) to provide pressurized air used in operating the stapler 150 and/or driving the linear actuator 154. Alternatively, the stapler 150 and the linear actuator 154 may be electrically-powered and the air fittings 182 omitted. In other embodiments, the stapler 150 and linear actuator 154 may be powered via any other suitable combination of motors, pneumatics, hydraulics, and the like.

In the illustrated embodiment of FIGS. 7-9, a camera 190 is coupled to each of the fastening units 102 generally adjacent the stapler 150. In particular, the camera 190 is fixed to the mounting plate 106. As such, the camera 190 does not pivot with the support plate 110 or translate with the rod 166. Thus, in the disclosed embodiment, one camera 102 is associated with each stapler 150. The cameras 190 associated with the fastening units 102 collectively define a vision system 200. As described in greater detail below, the vision system 200 can provide feedback used to determine the presence or absence of a portion of the wire grid 18 within each camera's field of view.

Figure 5:
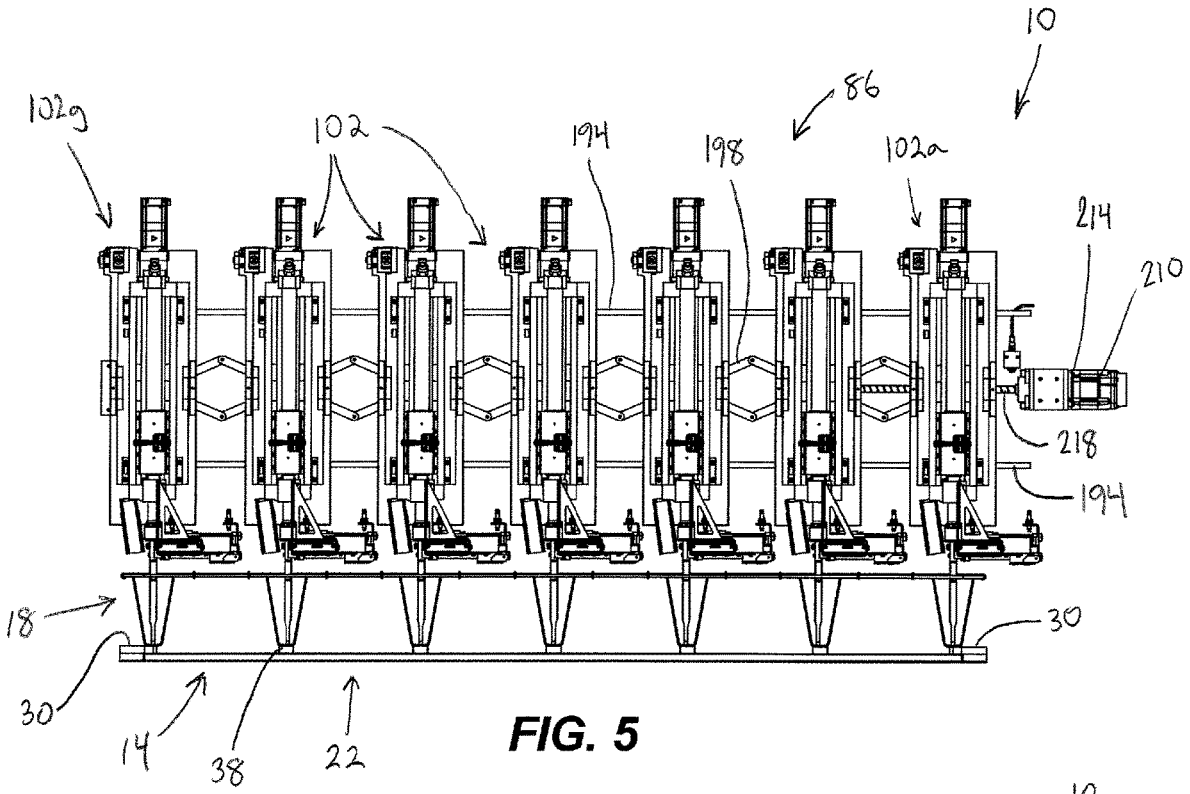
FIG. 5 is a front view of the fastening assembly of FIG. 4.
Figure 6:
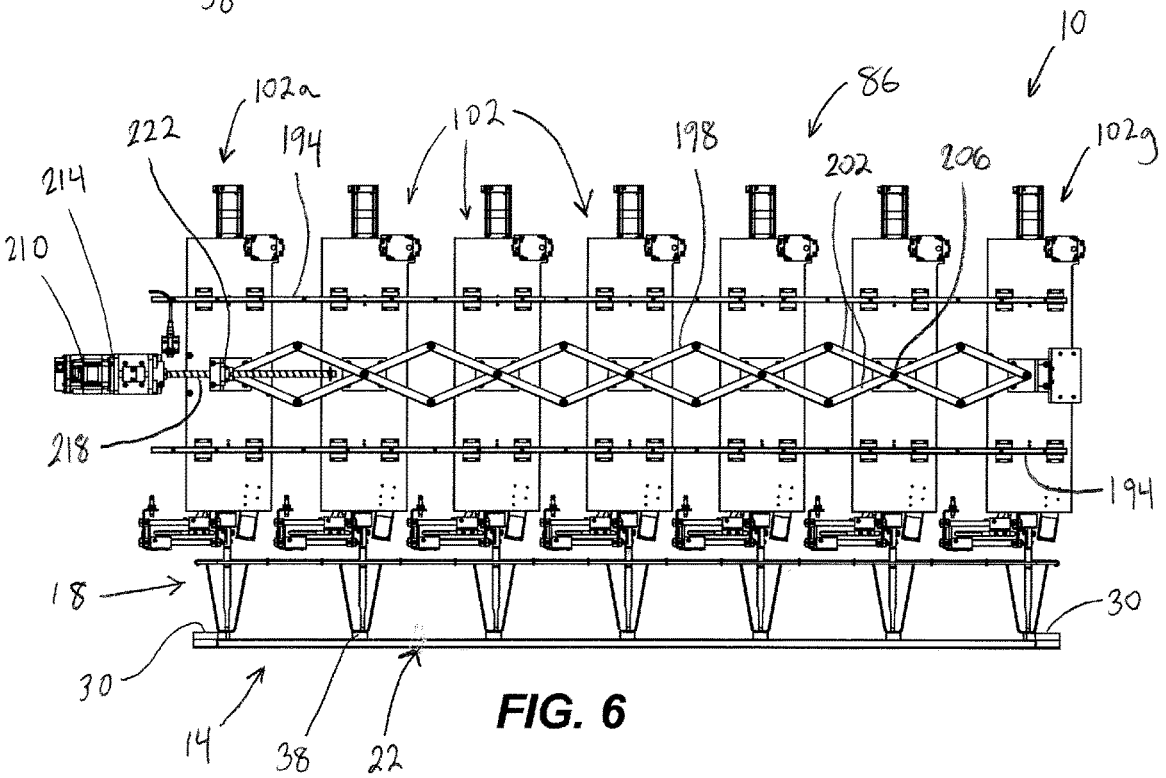
FIG. 6 is a rear view of the fastening assembly of FIG. 4.

With reference to FIGS. 4-6, the illustrated fastening assembly 86 includes seven fastening units 102 spaced across the width of the machine 10. The number of fastening units 102 corresponds with the total number of longitudinal slats 30, 38 on the box-spring 14. In other embodiments, the number of fastening units 102 may vary (e.g., if the box-spring 14 includes a different number of longitudinal slats 38). The fastening units 102 are aligned such that all of the respective pivot axes 122 are substantially parallel, and in the illustrated embodiment, the respective pivot axes 122 are coaxial. The fastening units 102 are preferably slidably supported on rails 194 that extend along and are attached to the center span 98 (FIGS. 5, 6). A linkage 198 interconnects each of the fastening units 102. In the illustrated embodiment, the linkage 198 is a scissors linkage with a plurality of pivotally coupled segments 202 arranged to cross at a plurality of center points 206. Each of the center points 206 is coupled to a respective one of the fastening units 102. In this way, the linkage 198 is extendible in order to increase a relative spacing between adjacent fastening units 102, and retractable in order to decrease a relative spacing between adjacent fastening units 102.

The fastening assembly 86 further includes a linkage actuator 210 operable to extend and retract the linkage 198. The illustrated linkage actuator 210 includes a motor 214 and a threaded rod 218 rotationally driven by the motor 214. The threaded rod 218 extends through a threaded bushing 222 coupled to a first one 102*a* of the fastening units 102 (FIG. 6). A last or seventh one of the fastening units 102*g*, which is farthest from the first fastening unit 102*a*, is fixed to the center span 98 of the structural support 90. Accordingly, rotation of the threaded rod 218 in a first direction draws the first fastening unit 102*a* toward the linkage actuator 210, causing the linkage 198 to extend and increase the relative spacing between adjacent fastening units 102. Likewise, rotation of the threaded rod 218 in a second, opposite direction displaces the first fastening unit 102*a* away from the linkage actuator 210, causing the linkage 198 to retract and decrease the relative spacing between adjacent fastening units 102. The linkage 198 can thus be extended and retracted to adjust simultaneously the lateral positions of the fastening units 102 together as a single unit across the width of the wood support frame 22 for lateral alignment with the longitudinal slats 30, 38. Being fixed to center span 98, fastening unit 102*g* always remains in the same lateral position relative to the center span 98 and the other fastening units 102 during extension and retraction of linkage 98. That is, while the other fastening units 102 simultaneously move laterally closer together or farther apart with retraction and extension of linkage 98, fastening unit 102*g* remains in a stationary position fixed to center span 198. In other embodiments, each of the fastening units 102 may be independently adjustable along the rails 194 to increase or decrease a relative spacing between two or more adjacent fastening units 102. For example, one, two, or more of the fastening units 102 may include a respective actuator (e.g., a motor, pneumatic actuator, hydraulic actuator, solenoid, and the like) that can adjust the position of the associated fastening unit 102 along the rails 194 in the width direction. In such embodiments, the lateral spacing between adjacent fastening units 102 may differ, and the lateral positions of one, two, or more of the fastening units may be independently controlled.

Figure 13:
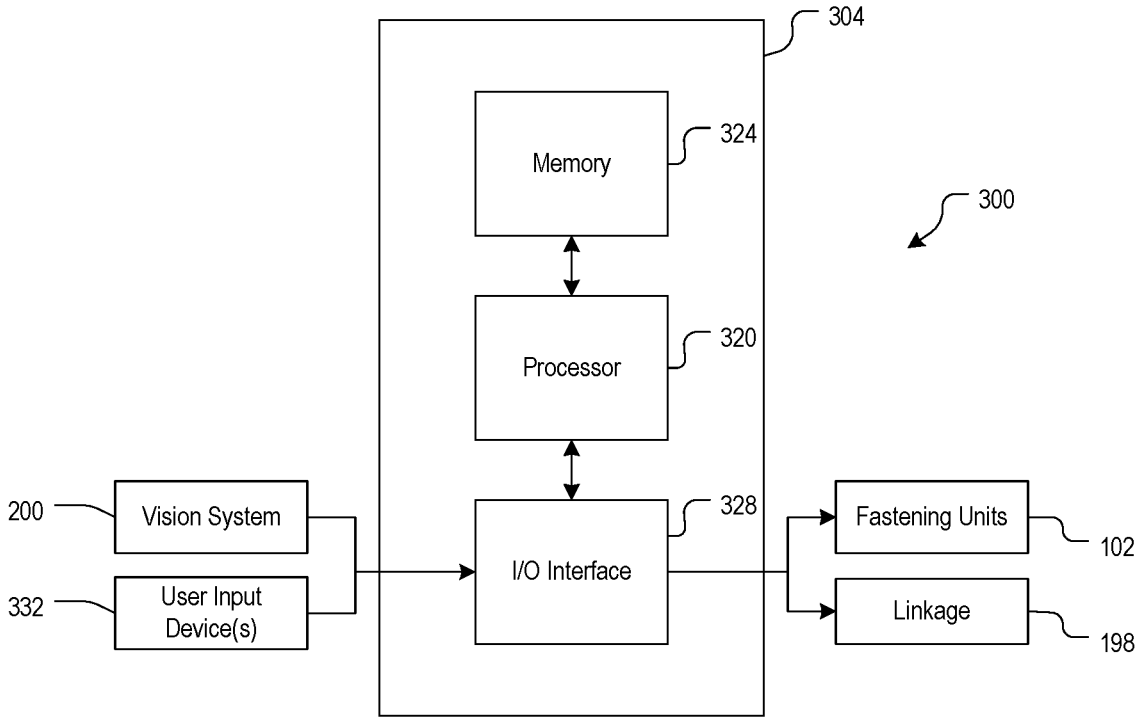
FIG. 13 is a schematic representation of a control system of the machine of FIG. 1.

Referring to FIG. 13, a computer-based control system 300 includes combinations of hardware and software that are programmed, configured, and/or operable to, among other things, control the operation of the machine 10. The control system 300 includes a controller 304, which may include a plurality of electrical and electronic components that provide power, operational control, and protection to the components and modules within the controller 304. In the illustrated embodiment, the controller 304 includes, among other things, an electronic processor 320 (e.g., a programmable microprocessor, microcontroller, or similar device), non-transitory, machine-readable memory 324, and an input/output interface 328. The input/output interface 328 is communicatively coupled to the vision system 200 to receive a vision guidance signal in the form of image data from the cameras 190. The input/output interface 328 is also communicatively coupled to one or more user input devices 332, such as a keyboard, keypad, mouse, touch screen, and the like. Additionally, the input/output interface 328 is communicatively coupled to the linkage 198 (e.g., for controlling operation of the linkage actuator 210) and the fastening units 102 (e.g., for controlling operation of the pivot actuators 126, linear actuators 154, and staplers 150).

The electronic processor 320 is communicatively coupled to the memory 324 and to the input/output interface 328. In other embodiments, the controller 304 includes additional, fewer, or different components. One or more control and/or data buses (not shown) may be provided for the interconnection between and communication amongst the various modules and components of the controller 304. Software and instructions included in the implementation of the machine can be stored in the memory 324 of the controller 304. The software may include, for example, firmware, one or more applications, program data, filters, rules, one or more program modules, and other executable instructions. The controller 304 is configured, operable, or programmed to retrieve from the memory 324 and execute, among other things, instructions related to the control processes and methods described herein.

Figure 10:
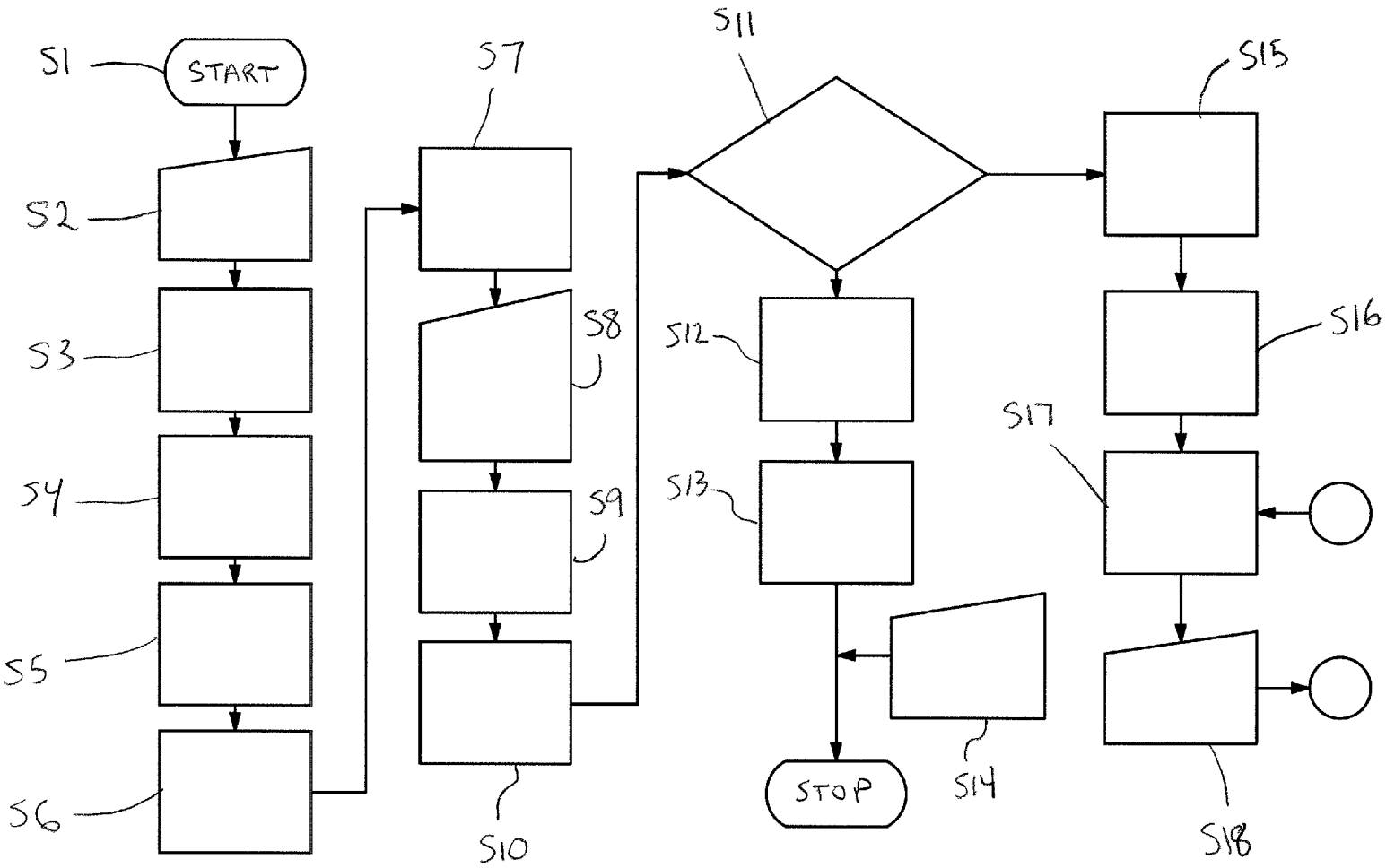
FIG. 10 is a process flow diagram illustrating a method of operating the machine of FIG. 1.
Figure 11:
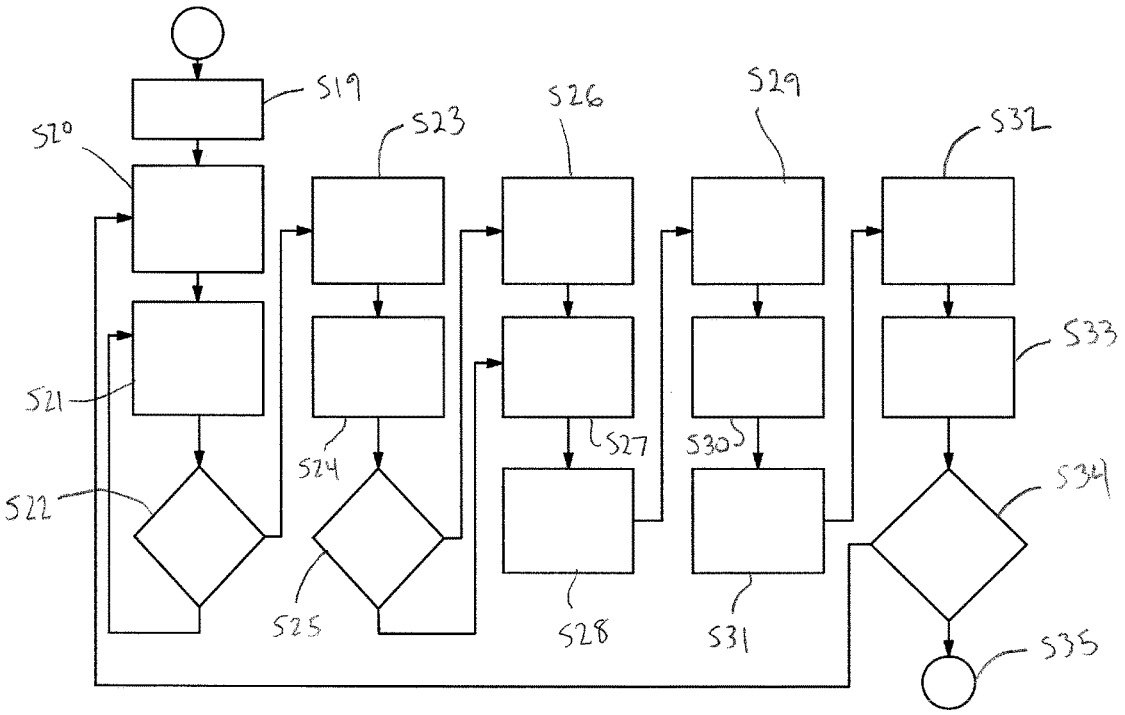
FIG. 11 is a process flow diagram further illustrating the method of operating the machine of FIG. 1.
Figure 12:
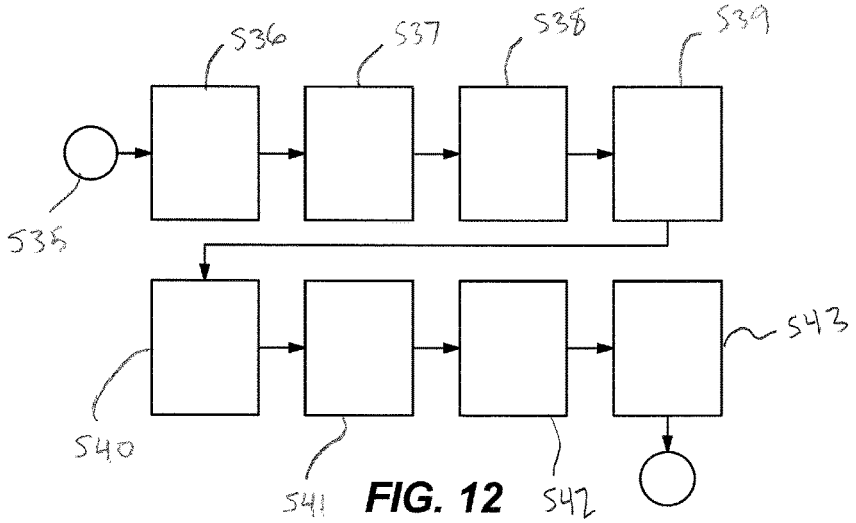
FIG. 12 is a process flow diagram further illustrating the method of operating the machine of FIG. 1.

FIGS. 10-12 illustrate an exemplary control flow for the control system 300 of the machine 10. Although the control flow is described and illustrated sequentially, the controller 304 may complete any of the steps and/or equations described herein simultaneously or in a variety of different sequences.

To begin operation, an operator starts an initialization program at step S1 and inputs into the controller 304 (e.g., via the user input device 332) a particular product size and design of box-spring at step S2. The user may input this information by making a selection from an on-screen menu, or by manually entering product size and design data. The controller 304 commands the linear actuators 154 to move the rods 166 to their upper positions at step S3, and the controller 304 commands the pivot actuators 126 to pivot the support plates 110 to a no-tilt position (such that the support plates 110 are parallel to the mounting plates 106) at step S4. The controller 304 also commands the carriage 74 to move to a starting or upstream position closest to the loading table 66 at step S5. Finally, the controller 304 commands the linkage actuator 210 to fully extend the linkage 198 at step S6, which moves the last fastening unit 102*g* and its associated camera 190 to a starting position. The lateral position of the first fastening unit 102*a* and associated camera 190 do not move when the linkage 198 is extended outwardly or retracted inwardly. With the movable components of the machine 10 thus initialized to appropriate starting or origin positions, the controller 304 may then indicate to the operator (e.g., via a visual or auditory signal) at step S7 that machine 10 is ready to receive a box-spring 14 to be assembled.

At step S8, the operator places a frame 22 on the load table 66 and a wire grid 18 on the wood frame 22. The operator manually pushes the frame 22 and accompanying grid 18 downstream toward the fastening assembly 86 and carriage table 70 until the front cross slat 34 of the frame 22 contacts a sensor (not shown) on gripper arms 82. Activation of the sensor on the gripper arms 82 starts a subroutine program at step S9 to adjust further the lateral position of the fastening units 102 under the control of the camera 190 on the first fastening unit 102*a* (end camera 190). In particular, the subroutine directs end camera 190 to find a location near the corner of the frame 22 where the outermost right-hand (from the operator's point of view at the upstream end of load table 66 downstream toward carriage table 70) longitudinal frame slat 30 overlaps the front cross slat 34. To find this location, the control system retracts the linkage 198 inward at step S10 as end camera 190 searches for this overlap by looking for a consistent straight-line pattern recognizable by end camera 190. The controller 304 analyzes the image data from end camera 190 as the linkage 198 continues to retract at step S11. If the controller 304 does not locate the overlap by the time the linkage 198 is fully retracted, it returns the linkage 198 to the extended position at step S12 and indicates a failure condition to the operator at step S13. The operator can then exit the program or perform other corrective action at step S14.

If end camera 190 does identify the overlap, the linkage 198 is further retracted a predetermined fixed distance until end camera 190 reaches an "ideal" position at step S15. That is, the linkage 198 is retracted until the overlap of the right-hand longitudinal slat 30 with the front cross slat 34 is at a known fixed position within the field of view of end camera 190. This relative distance with respect to the camera's field of view is preferably a set value for box-springs 14 independent of their different sizes.

With end camera 190 in the ideal position, the controller 304 begins a wire locating subroutine at step S16. The controller 304 then waits for an operator input to proceed at step S17. The controller 304 may provide a visual or audible indication to the operator that action by the operator is required. For example, the controller may change the state of an indicator light (e.g., from a blinking state to a solid on state) to indicate to the operator that the controller 304 is waiting for the operator to proceed. The operator then provides the input to the controller 304 to proceed at step S18 by depressing a foot pedal. Alternatively, the operator may provide the required input to the controller 304 via any other suitable type of button, switch, or the like.

The controller 304 proceeds by first closing the gripper arms 82 about the front cross slat 34 of the wood frame 22 at step S19, without contacting the wire grid 18 positioned on the frame 22. The vision system 200 is readied to direct movement of the frame 22 downstream underneath the fastening assembly 86 and to visually align the individual staplers 150 with the first row of the spring modules 51.

The carriage (or carriages) 74 begins to move the frame 22 and grid 18 downstream underneath the overhead fastening assembly 86 at step S20. The controller 304 is programmed to move the entire frame 22 downstream from the load table 66 onto the carriage table 70 a predetermined travel distance at step S21. For example, the controller 304 may be programmed to move a frame 22 an overall predetermined travel distance of 1600 mm, which would move the entire frame 22 from the load table 66 onto the carriage table 70. In some embodiments, the overall predetermined travel distance may be based on the size of the frame 22. During this movement, the controller 304 continuously polls all seven cameras 190 at step S22. When a predetermined number (e.g., three or more) of the seven cameras 190 visually identify and maintain within their field of view the bottom portion 62 of a spring module 51, the controller 304 issues a first stop command at step S23 to the carriage 74 to cease moving the frame 22 and wire grid 18. This first stop command initially aligns a row of spring modules 51 within the optical viewing range of the cameras 190. In contrast, if fewer than the predetermined number (e.g., only two or fewer) of spring modules 51 are identified in a particular wire row by the cameras 190 as the wire grid 18 moves downstream, the controller 304 will not issue a stop command, and the carriage 74 will continue to move the support frame 22. As a result, the entire row will be bypassed for stapling. In other words, the identification of three or more spring modules in the illustrated embodiment signifies the presence of a row of spring modules 51 to be stapled.

After the first stop command is issued and the carriage 74 stops moving, the controller 304 uses one camera 190 to determine a representative field of view for the vision system 200 ("the camera field of view"). The controller 304 then moves the support frame 22 downstream again at a slower rate of travel at step S24 than during step S21 to look for more wires 46 within a distance corresponding to the camera field of view. The controller 304 continuously polls the vision system 200 at step S25. If during this further movement of the wire grid 18 a second predetermined number of cameras 190 (e.g., five or more cameras, which may include some or all of the cameras 190 associated with the first stop command) each identify the bottom 62 of a spring module 51 within the representative camera field of view, the controller 304 immediately issues a second stop command at step S26. If during this second alignment step, however, fewer than five spring modules 51 have been identified, the controller 304 will issue the second stop command after the carriage 74 has moved the wire grid the distance corresponding to the camera field of view, regardless of how many spring modules 51 have been identified by the vision system 200.

After the second stop command, two further alignment adjustments are made as described below.

Each of the cameras 190 that has visually identified a spring module 51 is used to determine if there is a lateral offset between the camera's associated stapler 150 and the center of the underlying module 51. The measured offsets are then used to calculate a mean (or a median) offset for the entire bank of staplers 150. That is, each of the cameras 190 that has identified a spring module 51 sends an output signal to the controller 304 indicating the distance its associated stapler 150 is laterally offset from the center of the underlying spring module 51 (or the center of the bottom portion 62). With this information, the controller 304 then calculates a mean offset for the entire fastening assembly 86 at step S27.

At step S28, the controller 304 then adjusts the linkage 198 to move the entire fastening assembly 86 a distance equal to the calculated mean offset and thus bring the staplers 150 closer to the centers of the underlying spring modules 51. This occurs before the staplers 150 are commanded to move downward to staple. Lateral adjustment at step S28 only proceeds if the calculated mean offset falls within a predetermined tolerance or range. If the mean offset is not within this tolerance, the lateral adjustment is not made, and the staplers 150 will remain positioned at the original "ideal" lateral position.

After any lateral adjustment, for each camera 190 that has identified a spring module 51 in the underlying row, the associated stapler 150 is commanded to move downward in the direction of arrow 174 to staple the bottom of the underlying spring module 51 to the support frame 22 at step S29 (i.e., by commanding the associated linear actuator 154 to extend downward in the direction of arrow 174. If a camera 190 has not identified an individual underlying spring module 51, its associated stapler 150 is not commanded to move downward for stapling and remains in its initial, upper start position. Thus, for each row of spring modules 51, the feedback from each camera 190 determines whether the particular associated stapler 150 is commanded or directed to staple an underlying module 51 to the support frame 22. Put another way, the visual feedback or guidance from each camera controls whether the associated stapler 150 will be commanded to move downward to staple the bottom portion 62 of an underlying spring module 51 to a slat 30, 38 of wood support frame 22.

At step S30, for each stapler 150 commanded to move downward for stapling, its associated camera 190 remains active during the stapler's entire downward movement with the rod 166 to the stapling location. The camera 190 monitors the upstream/downstream position of the stapler 150 relative to the spring module 51 as the stapler 150 moves downward to the bottom of the underlying spring module 51 and communicates the stapler's relative position to the controller 304. When the camera's output to the controller 304 indicates that the stapler 150 is not properly aligned with the underlying spring module 51 in the upstream/downstream direction, the controller 304 directs the stapler's associated pivot actuator 126 to pivot the support plate 110 and thereby adjust the position of the stapler 150 relative to the bottom portion 62 of the module 51 as needed. Thus, the upstream/downstream position of each stapler 150 commanded to staple is controlled by its own associated camera 190 and pivot actuator 126 independently of any of the other staplers 150 or fastening units 102. When the end of the stapler 150 reaches its lowermost position over the bottom portion 62 of the module 51, the stapler 150 fires a staple into the frame 22 to fasten the bottom portion 62 of the module 51 to the frame 22 at step S31. The camera 190 also remains on and in communication with the controller 304 after stapling as the stapler 150 returns upward with the rod 166 in the direction of arrow 170 to its initial start position.

Once the staplers 150 have completed stapling in a single row of spring modules 51 and returned to their initial start position (vertically and laterally) at step S32, downstream movement of the frame 22 resumes within the predetermined overall travel distance for the frame 22. The controller 304 then increments a counter at step S33 in order to track how many rows of spring modules 51 have been fastened, and compares that count with a total row count associated with the particular box-spring at step S34. If the count is less than the total row count, the controller 304 returns to step S20 and repeats the process described above to staple another row of spring modules 51. In one embodiment, if the controller 304 is to continue processing to staple another row, the carriage 74 moves the grid 18 a predetermined distance (e.g., 30 mm) before again polling all seven cameras 190 at step S22.

Once all rows of a given wire grid 18 are stapled to the underlying support frame 22 or a predetermined overall travel distance of the entire wire grid 18 has been reached, the controller 304 executes a completion subroutine at step S35. In particular, the controller 304 moves the carriage 74 downstream, away from the operator to an eject position adjacent the downstream end of the carriage table 70 at step S36, where the gripper arms 82 open to release the wood support frame at step S37. The carriage 74 then drops beneath the carriage table 70 at step S38 and moves back upstream toward the load table 66 and operator at step S39, and to a "ready" position at step S40 to receive the next wood frame 22 at step S41. The controller 304 may then return linkage 198 to its initial position at step S42 and return to the initialization subroutine described above at step S43.

Various features of the disclosure are set forth in the following claims.

What is claimed is:

1. An apparatus for assembling a bedding foundation having a grid formed from rows of spring modules, each row of spring modules extending between a first side of the grid and a second side of the grid opposite the first side and having a plurality of spring modules positioned between the first side and the second side of the grid, and a frame to support the grid, the apparatus comprising:

a stationary horizontal support configured to receive the frame, the horizontal support having a length defining a lengthwise direction and a width;

a stationary bridge spaced over the stationary horizontal support and spanning at least partially across the width;

a bank of staplers configured to staple each spring module of the plurality of spring modules in each row of spring modules of the grid to a bottom portion of the frame, each stapler in the bank of staplers movably coupled to the stationary bridge and positioned over the stationary horizontal support, wherein each stapler in the bank of staplers is configured to staple a bottom portion of a respective spring module of the plurality of spring modules in each row or spring modules of the grid to the frame, wherein each stapler in the bank of staplers is further configured to move in a linear vertical direction relative to the stationary horizontal support independently of each of the other staplers in the bank of staplers and to pivot in the lengthwise direction independently of each of the other staplers in the bank of staplers and the staplers are movably coupled to the stationary bridge to adjust a spacing therebetween in a direction across the width of the stationary horizontal support;

actuators coupled to the stationary bridge, wherein each stapler in the bank of staplers is operated by one of the actuators to pivot in the lengthwise direction;

wherein the stationary horizontal support includes a stationary load table positioned on a first side of the stationary bridge and configured to receive the grid and frame, and a carriage table positioned on a second side of the stationary bridge opposite the first side and configured for removal of the grid and frame as stapled together by the bank of staplers; and a carriage movably disposed relative to the carriage table and configured to move the frame relative to the stationary bridge and the stationary horizontal support in the lengthwise direction underneath the stationary bridge from the stationary load table to the carriage table for stapling of the grid to the frame by the bank of staplers.

2. The apparatus of claim 1, further comprising cameras coupled and fixed in position relative to the stationary bridge, each stapler operatively associated with one of the cameras, wherein each camera is positioned to provide a field of view toward the stationary horizontal support.

3. The apparatus of claim 2, further comprising a controller in communication with each of the cameras, the controller configured to receive vision guidance signals from at least one of the cameras to adjust the spacing between each of the staplers in the bank of staplers in the direction along the width of the stationary horizontal support, adjust the movement of select staplers in the bank of staplers in the linear vertical direction relative to the stationary horizontal support, and adjust the pivoting of select staplers in the bank of staplers in the lengthwise direction.

4. The apparatus of claim 3, wherein the controller is configured to receive vision guidance signals from at least one of the cameras to direct the movement of the carriage.

5. The apparatus of claim 4, wherein the controller is configured to issue a first command to adjust the spacing between each of the staplers in the bank of staplers in a direction along the width of the stationary horizontal support in response to a first vision guidance signal, to issue a second command to move the carriage, to issue a third command to stop movement of the carriage in response to a second vision guidance signal, and to issue a fourth command to move at least some of the staplers in the bank of staplers in the linear vertical direction relative to the stationary horizontal support in response to a third vision guidance signal.

6. The apparatus of claim 1, wherein each stapler of the bank of staplers is movably mounted on a vertical track that is pivotally coupled to the stationary bridge.

7. The apparatus of claim 1, wherein each stapler in the bank of staplers is coupled to a common linkage that is configured to extend in a direction across the width of the support to increase the distance between each of the staplers in the bank of staplers and to retract in a direction across the width of the support to decrease the distance between each of the staplers in the bank of staplers.

8. The apparatus of claim 1, further comprising a controller configured to issue a command to pivot at least one of the staplers in the bank of staplers in response to a vision guidance signal.

9. The apparatus of claim 1, wherein each stapler in the bank of staplers is pivotable in the lengthwise direction while moving in the linear vertical direction.

10. An apparatus for assembling a bedding foundation having a grid formed from rows of spring modules, each row of spring modules having a plurality of spring modules positioned between a first end and a second end of the row, and a frame to support the grid, the apparatus comprising:

a stationary support configured to receive the frame, the stationary support having a length defining a lengthwise direction and a width;

a stationary bridge spaced over the stationary support and spanning at least partially across the width; and a bank of staplers configured to staple each spring module of the plurality of spring modules in each row of spring modules of the grid to a bottom portion of the frame, each stapler in the bank of staplers movably coupled to the stationary bridge, each stapler of the bank of staplers configured to staple a respective spring module of the plurality of spring modules in each row of spring modules of the grid to the frame, and wherein each stapler in the bank of staplers is further configured to move in a linear vertical direction relative to the stationary support independently of each of the other staplers in the bank of staplers and to pivot relative to the stationary support in the lengthwise direction, and wherein at least two staplers in the bank of staplers are movably coupled to the stationary bridge to adjust a spacing therebetween in a direction across the width of the stationary support, and wherein the stationary support includes a stationary load table positioned on a first side of the stationary bridge and configured to receive the grid and frame, and a carriage table positioned on a second side of the stationary bridge opposite the first side and configured for removal of the grid and frame as stapled together by the bank of staplers; and a carriage movably disposed relative to the stationary support and configured to move the frame relative to the stationary bridge and the stationary support in the lengthwise direction underneath the stationary bridge from the stationary load table to the carriage table for stapling of the grid to the frame by the bank of staplers.

11. The apparatus of claim 10, further comprising cameras coupled and fixed in position relative to the stationary bridge, each stapler operatively associated with one of the cameras, wherein each camera is positioned to provide a field of view toward the stationary support.

12. The apparatus of claim 11, further comprising a controller in communication with each of the cameras, the controller configured to receive vision guidance signals from at least one of the cameras to adjust the spacing between the at least two staplers in the bank of staplers in the direction along the width of the stationary support, adjust the movement of select staplers in the bank of staplers in the linear vertical direction relative to the stationary support, adjust the pivoting of select staplers in the bank of staplers in the lengthwise direction, and adjust relative movement between the frame and the bank of staplers in the lengthwise direction.

13. The apparatus of claim 10, wherein each stapler in the bank of staplers is pivotable in the lengthwise direction while moving in the linear vertical direction.

* * * * *